United States Patent [19]

Budrean et al.

[11] Patent Number: 4,562,719

[45] Date of Patent: Jan. 7, 1986

[54] METHOD FOR DRAWING HEAVY WALL SHELLS WITH A MULTI-STEP INSIDE EDGE

[75] Inventors: John D. Budrean, DeMotte, Ind.; John A. Kirkpatrick, Chicago Heights, Ill.

[73] Assignee: Verson Allsteel Press Company, Chicago, Ill.

[21] Appl. No.: 705,357

[22] Filed: Feb. 25, 1985

Related U.S. Application Data

[60] Division of Ser. No. 535,064, Sep. 23, 1983, Pat. No. 4,527,413, which is a continuation-in-part of Ser. No. 408,015, Aug. 13, 1982, Pat. No. 4,509,356.

[51] Int. Cl.[4] ..... B21D 22/00

[52] U.S. Cl. ..... 72/349; 72/375; 72/405

[58] Field of Search ..... 72/347–349, 72/345, 362, 375, 405

[56] References Cited

U.S. PATENT DOCUMENTS

| | | | |
|---|---|---|---|
| 3,893,321 | 7/1975 | Oberlander | 72/347 |
| 3,998,087 | 12/1976 | Schumacher | 72/405 |
| 4,147,049 | 4/1979 | Book | 72/349 |

FOREIGN PATENT DOCUMENTS

| | | |
|---|---|---|
| 1932139 | 1/1971 | Fed. Rep. of Germany . |
| 1253845 | 1/1961 | France . |
| 1602539 | 11/1981 | United Kingdom . |

*Primary Examiner*—Leon Gilden

*Attorney, Agent, or Firm*—Jerry W. Mills; Gregory M. Howison

[57] ABSTRACT

A forming machine (10) is provided for forming a finished part (12) from a flat blank (14). Draw stations (18–24) are provided to initially form the intermediate part. Each draw station includes a punch (44, 62, 66, 70') and a draw die (48, 64, 68, 72). Each punch defines a shoulder along its length to create a first step (60) in the side walls (26) of the intermediate part. In a subsequent draw stage, a draw punch (70') forms a second shoulder along its length to create a second step (100) in the side walls (26) of the intermediate part. A draw shoulder (61) on the draw punch (71') mates with the step (60) to maintain the concentric shape thereof. In the subsequent necking and final form stages (30, 32, 34) the punch employed also has a shoulder to permit variation of the force applied to the intermediate part between the step and bottom portion.

7 Claims, 21 Drawing Figures

METHOD FOR DRAWING HEAVY WALL SHELLS WITH A MULTI-STEP INSIDE EDGE

This is a divisional of application Ser. No. 535,064 filed Sept. 23, 1983, now U.S. Pat. No. 4,527,413, which is a continuation-in-part of Ser. No. 408,015, filed Aug. 13, 1982, now U.S. Pat. No. 4,509,356.

TECHNICAL FIELD

The present invention relates to the forming of metal, and in particular to the forming of metal by drawing.

BACKGROUND ART

The drawing of metals into a variety of shapes is a well-known metal forming process. These shapes include cylindrical cups and tubes with curved side walls as well as shapes with angular side walls, with square or rectangular cross sections, for example. Countless numbers of items are produced by this process, with one example being a grenade body. Typical metals used in the process are carbon steel, alloy steel, aluminum, and brass, as well as other types of metals.

A common shape desired to be formed by drawing is essentially a cylindrical cup formed with one end closed. The cup may be drawn in a single or multistage process. Each stage includes a punch which drives the metal to be formed into a die to form an intermediate or final shape. In the typical multi-stage process, the metal is processed through a number of draw stations and completed in a series of finishing stations. The number of draw stations required depends upon the inside diameter of the cylinder, the height of the cylinder, metal thickness and physical properties of the metal.

Previously known punch and die forming machines are adequate to form cup shapes when the desired end configuration does not need to be sharply defined with very close dimensional tolerances. With thicker materials, the prior known processes are not adequate. With such thick material, the punch is pressing against a small cross section at the bottom of the drawn part while pulling the part through the die. This imposes a tensile stress in the cylindrical portion of the cup. If the tensile stress in the cylindrical portion exceeds the ultimate tensile strength of the material, the bottom of the cup will separate from the cylinder, thereby resulting in a defective part. Even though ultimate failure may not occur, excessive thinning of portions of the cup can cause cracks and splits to occur.

A prior attempt to eliminate problems in drawing is disclosed in U.S. Pat. No. 4,147,049 issued to Book et al. on Apr. 3, 1979. This patent discloses the use of supplemental sleeves which assist a punch in drawing a cup into a die by contacting the open end of the cylindrical cup to reduce the tensile stress in the cylindrical portion of the cup. However, with such a prior technique, the open end of the cylindrical cup drawn does not always remain perfectly square with the axis of the cylinder. Depending on the properties of the metal drawn and the ratio of length to diameter of the drawn part, the open end may have an irregular or wavy surface of variable severity so that the supplemental sleeves do not provide a uniform compensating stress within the cylindrical portion of the cup. The height of these irregularities varies from part to part and it is therefore impossible to apply a constant force on each part.

A need therefore exists to overcome the above recorded problems in drawing metal. In particular, a need exists to reduce the tensile stress in the side wall portions of a drawn piece to permit precisely controlled shaping held to extremely close tolerances and even permit changes in thickness of metal within a closed end of the piece.

SUMMARY OF THE INVENTION

In accordance with one aspect of the present invention, an apparatus is provided for forming a material into a cup part having side walls and a bottom portion. The apparatus includes a first step forming stage of forming for forming a step in the walls of the parts. The first step forming stage includes a die and cooperating punch to draw the material through the die to form the cup part. The punch has a nose portion for contacting the bottom portion of the cup part and an enlarged portion or portions for forming an annular surface or surfaces on the side walls perpendicular to the axis of the drawn cup part. A second and subsequent step forming stage includes a die and cooperating punch to draw the material through the die to form the cup part. The punch for the second step forming stage has a nose portion for contacting the bottom portion of the cup part and an enlarged midportion for forming a first annular surface on the side walls perpendicular to the axis of the cup part to form at least a secondary step. A neck portion on the punch of the second step forming stage has a larger diameter than the midportion thereof to form a draw shoulder on the punch to mate with the primary step formed in the initial step forming stage.

In another embodiment of the present invention, at least one finishing stage of forming is provided to form the bottom portion of the cup part. The finishing stage includes a finishing die and cooperating punch to form the material through the finishing die. The punch includes structure for contacting the primary and secondary steps in the side walls of the drawn cup part to control the stresses in the side walls thereof.

In yet another embodiment of the present invention, a method for forming a material into a cup part having side walls and a bottom portion is provided. The method includes the step of forming the material in at least two stages. The first stage includes a die and cooperating punch to draw the material to the die to form the cup part. The punch in the first stage has a nose portion for contacting the bottom portion of the cup part and an enlarged portion for forming an annular surface on the side walls perpendicular to the axis of the drawn cup part to form a primary step. The second stage of forming comprises forming a second step in the part closer to the bottom of the part with a punch that has a nose portion for contacting the bottom portion of the cup part, and an enlarged midportion for forming the additional step in the side walls of the drawn cup part and an enlarged neck portion for forming a draw shoulder on the punch to mate with the primary step from the first step forming stage.

BRIEF DESCRIPTION OF THE DRAWINGS

A more complete understanding of the invention may be had by reference to the following Detailed Description taken in conjunction with the accompanying Drawings, wherein.

DETAILED DESCRIPTION

Figure 1:
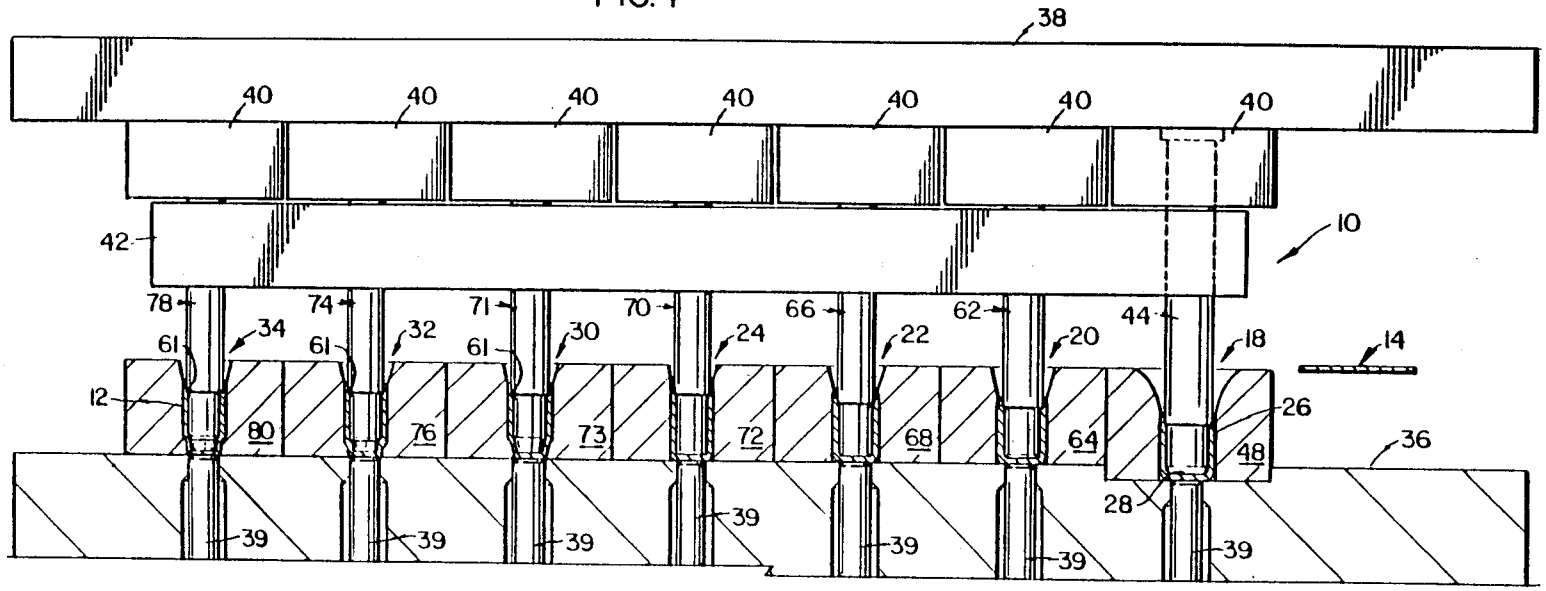
FIG. 1 is a partial side cross-sectional view of a forming machine incorporating the teachings of the present invention.

Referring now to the drawings, wherein like reference characters designate like or corresponding parts throughout several views, FIG. 1 illustrates a forming machine 10 for forming a finished cup part 12 from a circular plate-like blank material 14. Cup part 12 may have any desired cross section, while the material 14 can comprise any formable metal or other formable material.

The forming machine 10 performs three major formation functions which can include one or more individual forming stations. The first function is the drawing of the material 14 at the first draw station 18, second draw station 20, third draw station 22 and fourth draw station 24. Each draw station progressively decreases the diameter of the intermediate cup part shape and increases the length of the side walls 26. The thickness of both side walls 26 and bottom portion 28 remain substantially the same. The number of draw stations varies with part size and material and four draw stations are shown merely as an example.

The bottom portion 28 of the finished cup part 12 is formed in the final two formation functions. The second formation function is performed by first necking stage 30 and second necking stage 32 which act primarily to form the bottom portion 28. The number of necking stages is dependent upon the complexity of the bottom portion configuration. The third formation function is performed by a final form station 34 which forms the final shape of bottom portion 28.

The forming machine 10 includes a lower die shoe 36 which is typically stationary. An upper die shoe 38 is supported for vertical motion above the lower die shoe 36. Each of the stations include a punch, a die and an ejector pin 39. The punches for the stations are located by punch holders 40 secured to the upper die shoe 38. Each of the dies are located on the lower die shoe 36. Die and punch loads are supported by the lower die shoe 36 and upper die shoe 38, respectively. The ejector pins 39 at each stage are movable relative to the associated dies to remove a formed intermediate or final cup part from the die. The ejector pins 39 lift the formed final or intermediate cup parts free of the dies as seen in FIG. 2*h*. The pins 39 can also function to support bottom portion 28, or so called "coining" loads. The coining load is supported by lower die shoe 36. The pins 39 could be operated by mechanical cam operation, air cylinders or nitrogen or hydraulic cushions at each station, or a cross bar actuated by two cushions in the bed of the machine 10. A stripper 42 is provided with apertures to permit passage of the punches therethrough for stripping the formed intermediate or final cup part from the punch. Stripper 42 can be substituted for by lever type strippers at each station, cross bar knockouts provided in the slide of the machine 10 or another suitable type. An individual finished cup part 12 is formed from material 14 by moving the piece sequentially through each stage from right to left as seen in FIG. 1. Apparatus for performing this transfer is well-known in the art and will not be described.

Figure 2A:
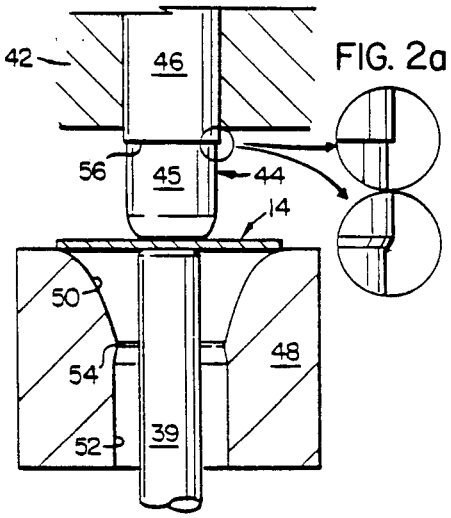
FIGS. 2*a–h* are sequential detail illustrations of the forming of a cup part in one stage of the forming machine.

The punch 44 employed in the first draw station 18 is formed with a relatively reduced diameter nose portion 45 and a relatively enlarged diameter portion 46 as best seen in FIG. 2*a*. The draw die 48 has an upper die surface 50 having a wide flare and a relatively straight lower die surface 52 separated by the minor diameter 54. The dimensions of surface 52 and diameter 54 can vary, and in some die designs can be identically sized.

Figure 2B:
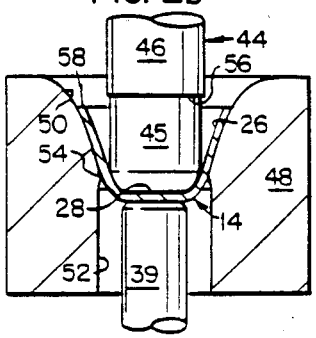
Figure 2C:
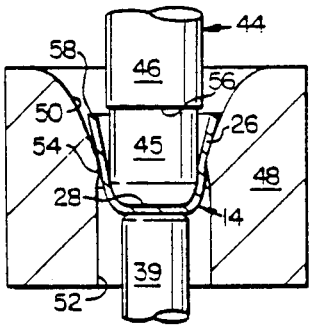
Figure 2D:
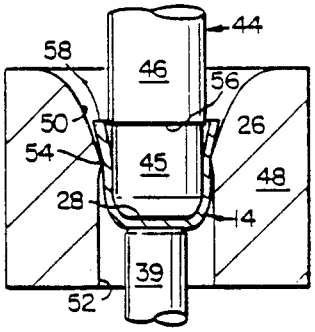
Figure 2E:
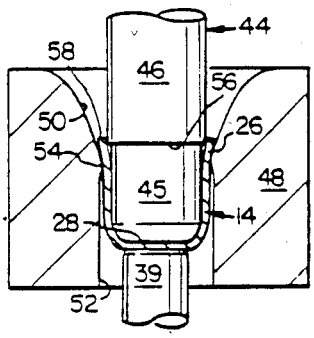
Figure 2F:
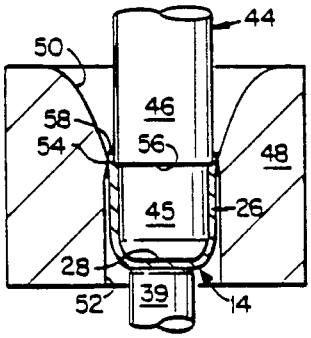
Figure 2G:
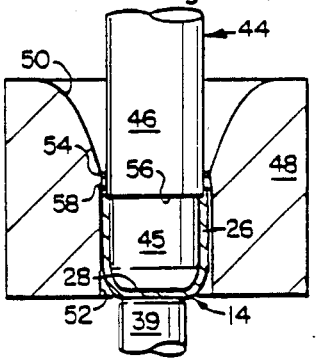
Figure 2H:
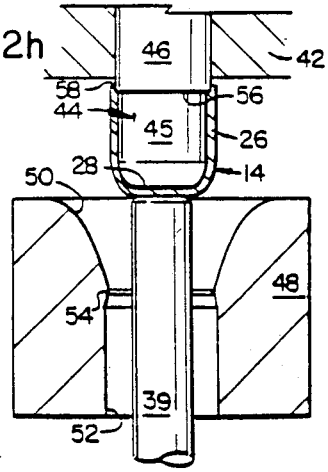

The pressure applied by the decending punch 44 initially deforms the material 14 as shown in FIG. 2*b* to fit into the contour of the upper die surface 50 of the draw die 48. As the punch 44 continues to decend, it pulls the material through the minor diameter 54 of the draw die 48 to form essentially a straight wall intermediate cup shape as illustrated in the sequence of FIGS. 2*c–h*.

During this draw process, the punch 44 is pressing against a small cross section of the bottom portion 28 of the material being drawn through the draw die 48. This imposes a tensile stress in the side walls 26 of the immediate cup part. The contour of the die surfaces 50 and 52 are carefully developed to suit the metal thickness and particular metal to be formed and is an important consideration in the design of the die.

Figure 3E:
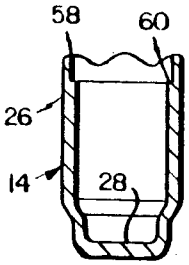
FIGS. 3*a–e* are cross-sectional side views of the cup part formed in each of the draw stages of the forming machine and the final form station.
Figure 3D:
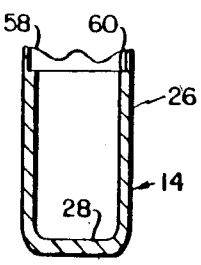
Figure 3C:
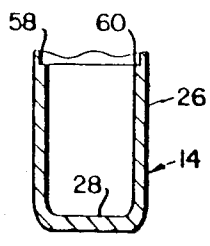
Figure 3B:
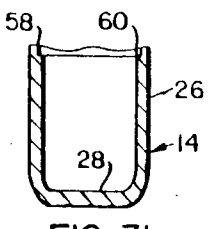
Figure 3A:
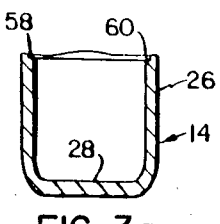

It can be readily observed from FIGS. 1 and 2 that the interface between the nose portion 45 and enlarged diameter portion 46 forms an annular surface 56 on the punch 44 perpendicular the motion of the punch. The annular surface 56 can be sharply defined, as seen in the upper detail view in FIG. 2*a* or have a more gradual definition as seen in the lower detail view of FIG. 2*a*. The annular surface 56 can be formed by fitting a sleeve over a punch with the same outer diameter as nose portion 45. The length of the nose portion 45 is designed so that the enlarged diameter portion 46 passes the minor diameter 54 of the draw die 48 before the open end 58 of the intermediate cup part passes through the minor diameter 54. The clearance between the outside diameter of the enlarged diameter portion 46 and the minor diameter 54 is less than the metal thickness of the intermediate cup part. Therefore, the final relatively small amount of material that passes through the draw die is reduced in wall thickness to create an annular surface or step 60 at the open end as best seen in FIG. 3*a*. However, the step 60 can be formed at any position along side walls 26 desired and need not be near the open end. For example, the specification of a part may require an annular step to be formed on the side wall in the final shape. In the past, a separate machining step would be required to form this step. Under the teachings of the present invention, the annular surface 56 can be positioned to form the step at the specified position. The distance from the material contacting surface of the nose portion 45 and the step 60 is precisely controlled. The step is formed perpendicular and concentric to the axis of the drawn intermediate cup part and motion of direction of punch 44. The volume of material within the intermediate cup part below the step 60 is therefore established precisely which is critical for controlling part definition in subsequent operations. However, it should be understood that the step 60 can be formed concentric and at an angle to the axis of the drawn intermediate cup part. This results in an annular shoulder tapering inwardly toward the bottom portion 28. The surface of this annular shoulder can also have a radius formed therein with the radial center thereof external or internal to the formed part.

The second draw stage 20 includes a punch 62 and draw die 64. The third draw station 22 includes a punch 66 and a draw die 68. The fourth draw station 24 includes a punch 70 and draw die 72. Each of the punches 62, 66 and 70 also include a nose portion and enlarged diameter portion. The punches and draw dies are designed to progressively decrease the cup diameter and increase the cup length of the intermediate cup part as illustrated in FIGS. *3a–d*. The difference in diameter of the nose portion and enlarged diameter portion at each station progressively increases to increase the amount of step 60 in the drawn cup part, again as best seen in FIGS. *3a–d*. At the completion of the fourth draw, the step 60 in the intermediate cup part has been fully developed. It will be observed that the irregularity of the open end 58 of the intermediate cup parts becomes more severe upon each draw. However, the step 60 formed in the draw processes retains its concentricity and shape with respect to the angle thereof formed with the axis of the drawn part.

It is not necessary to always increase the difference in diameter of the nose portion and enlarged diameter portion at each station. The step formed in the side walls depends not only on this difference, but on the force transmitted through the punch to the side walls. For example, punches 44 and 62 can have the same diameter difference and punches 66 and 70 have the same, albeit layer, diameter difference. The force exerted on the formed part by punches 44, 62, 66 and 70 can then be varied to achieve the development of the step in four stages as done by the punches illustrated in FIGS. *2c–h*. The step 60 at the open end of the intermediate cup part can be used in the subsequent forming of the bottom portion 28 at the first necking station 30, second necking station 32 and final forming station 34 to result in the final form shown in FIG. *3e*. The first necking station 30 includes a punch 71 and die 73. The second necking station 32 includes a punch 74 and die 76. The final forming station 34 includes a punch 78 and die 80. The term necking refers to the configuration imparted to the bottom portion 28. The number of necking operations are therefore dependent upon the complexity of the configuration desired in the bottom portion 28.

With the step 60, uniform forming pressure can be applied to the side walls adjacent to the open end 58 of the intermediate cup part simultaneously with application of pressure through the nose portion of the punches 71, 74 and 78 at each of the stations 30, 32 and 34. Forming pressure can be applied solely through the side walls if desired. The punches 71, 74 and 78 at each of the stations are made with a relatively reduced diameter nose portion and a relatively enlarged diameter portion. The interface or shoulder 61 on the punches 71, 74 and 78 can be positioned to contact the step 60 to provide the desired ratio of force applied through the step 60 and to the bottom portion 28. It can readily be seen that the precise location of the step 60 established by the draw stations 18–24 and the perpendicularity of step 60 to the axis of the cup part enables application of uniform compressive forces throughout the circumference of the part and consistently for every part formed. However, it is not necessary, as described above, to have the step 60 dimensioned perpendicular to the axis of the drawn part to apply uniform compressive forces throughout the circumference of the part.

The compressive forces applied to the cup part through the step 60 assists greatly to move the material and cause the material to fill the envelope defined by the punch on the inside and the die on the outside thereof. It is also possible to control the amount of compressive forces applied through the cylindrical portion. For example, for some parts it may be desirable to apply all of the forming pressure through the side walls 26 at step 60 and none through the nose portion of the punch to the bottom portion 28.

While the present invention is described and illustrated by the formation of a cylindrical cup shape, many other shapes can be formed by employing the teachings of the present invention. For example, shapes having curved side walls with a non-circular cross section can be formed. Also, shapes having angular side walls can be formed, including shapes with square and rectangular cross sections, and polygon cross sections such as hexagons and octagons. Shapes can also be formed with apertures or holes in the bottom portion. These apertures can be smaller than the inner dimensions of the side walls and have any desired configuration. The apertures can be as large as the inner dimensions of the side walls to form a tubular or duct. Force can be applied through the step in the side walls of the tubular or duct part to form a desired geometric shape to one end of the port.

With a non-circular shape, the step formed in the side walls would not be annular. However, the step would always define a surface that maintains the initial angular relationship to the direction of motion of the punch and would closely approximate the cross section of the side walls. The punches and dies would naturally be made to produce the desired part shape and step configuration.

Referring now to FIGS. *4a–g*, there is illustrated a series of forming steps for an alternate embodiment of the present invention. FIGS. *4a–c* represent first, second and third drawing stages which are identical to the stages depicted in FIGS. *3a–c*. These drawing stages are effected utilizing the dies 48, 64 and 68 with the corresponding punches, 44, 62 and 66 respectively. Each of the successive drawing stages represented in FIGS. *4a–c* effectively increases the length of the sidewalls 26 and the diameter thereof.

In FIG. *4d*, there is illustrated the fourth draw stage of the operation illustrating a punch 70' disposed within the material 14. The punch 70' is comprised of an upper portion 90, a middle portion 92 having a smaller diameter than the upper portion 90 and a nose portion 94 having a yet smaller diameter. The decrease of diameter between the upper portion 90 and the middle portion 92 forms a shoulder 96 that is operable to mate with the step 60. The interface between the middle portion 92 and the nose portion 92 forms a shoulder 98 that, as illustrated, is beveled with a downward and inwardly tapering wall from the lower edge of the middle portion 92 to the top of the nose portion. However, it should be understood that the shoulder 98 may be perpendicular and concentric to the axis of the part and the motion of the punch 70'. In addition, the shoulder 98 can have a radial cross section with the radial center thereof external to the punch 70'.

Figure 4A:
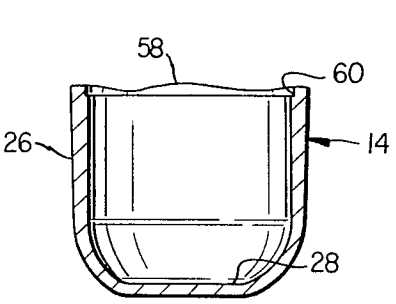
FIGS. 4*a–g* are cross-sectional side views of another embodiment of the cup part forming apparatus wherein multi-step side walls are formed.
Figure 4B:
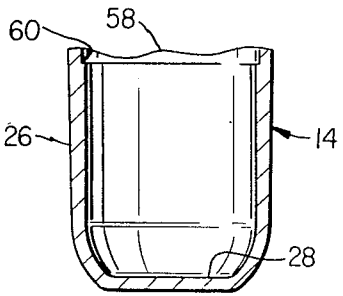
Figure 4C:
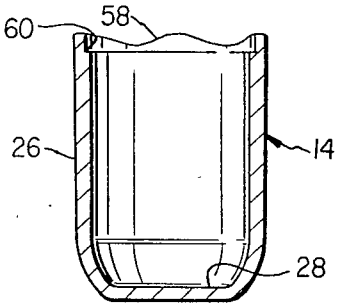

Upon passing through the moderate diameter of the die 72, the increase in diameter between the nose portion 98 and the middle portion 92 causes the sidewalls 26 to decrease in thickness, thereby forming an step 100 on the inner walls thereof. Therefore, the step 100 that has been formed is in addition to the step 60. As the material 14 is being drawn through the die 72, the thickness of the wall 26 is defined by the diameter of the various portions of the punch 70' in relation to the minor opening through the die 72. As the nose portion 94 passes through the die 72, the overall length of the wall 26 increases depending upon the decrease in diameter from that illustrated in FIG. 4*c*. As the shoulder 98 passes through the die 72, the thickness of the wall 26 decreases to form the step 100. The dimension between the shoulders 96 and 98 is designed such that when the shoulder 96 passes through the die 72, it mates with the step 60. As described above, the angular relationship of the step 60 with respect to the axis of the part and the direction of motion of the punch 70' is maintained. In a similar manner, the angular relationship of the step 100 with respect to the axis of the part is also maintained.

Figure 4E:
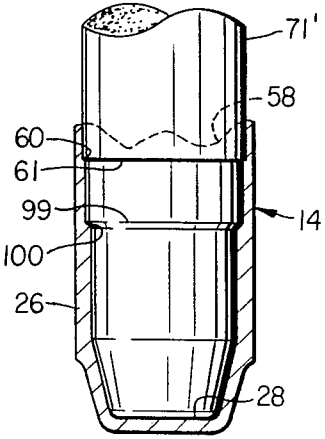
Figure 4F:
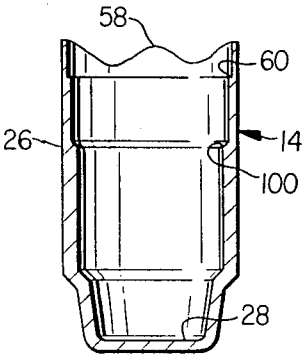
Figure 4G:
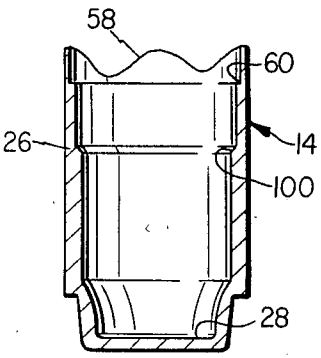
Figure 4D:
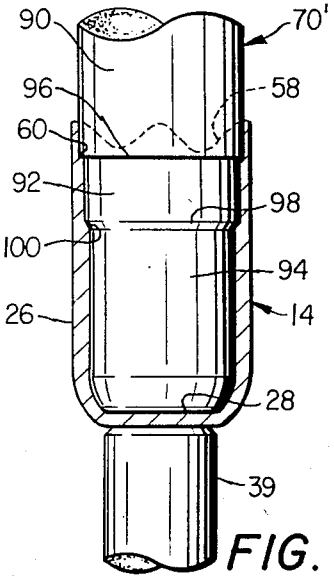

FIGS. 4*e*–4*g* illustrate three necking stages to form a desired shape for the lower portion of the cup 12. A punch 71' is utilized in the stage represented in FIG. 4*e* to perform the necking function. This function is identical with the neck formed in FIG. 3*e*. However, the punch 71' has an additional edge 99 as compared to the punch 71 utilized with the first stage of the necking to form the cup part in FIG. 3*e*. This shoulder 99 is operable in conjunction with the shoulder 61 to apply uniform forming pressure to the sidewalls adjacent to the open end 58 of the intermediate cup part simultaneously with application of pressure to the nose portion of the punch 71'. Forming pressure can be applied solely through the sidewalls as desired. As described above, both of the shoulders 61 and 99 can be positioned to contact the steps 60 and 100, respectively, to provide the desired ratio of force applied through the respective steps to the bottom portion 28. In this manner, the longitudinal forces directed along the longitudinal axis of the punch 71' can be dispersed along the length of the wall 26.

FIGS. 4*f* and 4*g* illustrate additional necking stages that are equivalent to the stations 32 and 34 with the exception that they utilize punches having a shoulder to mate with the step 100. The shoulders are not shown for simplicity purposes.

The height in the inside diameter of the step 100 may be altered within certain limits to suit dimensional requirements of a desired part. Although not shown, it is possible to form additional steps simultaneously with the second step by utilizing another punch in the fourth drawing stage. For some applications, the second and/or additional steps are required and would otherwise be produced by the additional step of machining. Imparting the steps in the metal forming operation further reduces the diameter of the blank with an associated reduction of the amount of material used. If desired, a groove or threads can be formed along the inside of the walls 26 with machining at a later time. With the additional steps, the amount of metal that must be removed by machining is substantially reduced in the metal forming operation.

While the present invention has been described with a forming machine having a given number of stages, it is clear the invention may be adapted for use with any number of stations. The present invention greatly enhances the ability to precisely form complex closed ends and uniform wall thickness by applying forming pressure through both the nose portion of a punch and through compressive forces applied in the cylindrical portion through the step formed therein.

Although only a single embodiment of the invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit and scope of the invention.

What is claimed is:

1. A method of forming a material into a part having side walls comprising the steps of:

contacting the material with a first draw punch, said first draw punch having a diameter variation along its length to define a primary draw shoulder thereon;

drawing the material through a first draw die with said first draw punch to form the material;

forming a primary step on the side walls of the part between the draw shoulder on said first draw punch and said first draw die at an angle to the axis of the part;

contacting the material with a second draw punch, said second draw punch having at least two diameter variations along its length to define a first and second draw shoulder;

drawing the material through a second draw die with said second draw punch to form the material; and forming a secondary step on the side walls of the part between the draw shoulder on said second draw punch and said second draw die at an angle to the axis of the part such that said second draw shoulder contacts said primary step on the side walls of the part.

2. The method of claim 1 further comprising the steps of:

contacting the part with a finishing punch, said finishing punch having at least two diameter variations along its length to define a first and second finishing shoulder; and forming the part through a finishing die with said finishing punch, force being applied to the part by contact between said first and second finishing shoulders and said primary and secondary steps, respectively.

3. The method of claim 1 further for forming a material into a part having side walls and a bottom portion, said step of contacting the material with said first and second draw punches including the step of contacting the bottom portion of the part with a nose portion of each of said draw punches.

4. The method of claim 2 further for forming a material into a part having side walls and a bottom portion, said step of contacting the part with said finishing punch including the step of contacting the bottom portion of the part with a nose portion on said finishing punch, the position of said first and second finishing shoulder on the finishing punch determining the relative ratio of force applied to the step and bottom portion of the part during forming.

5. The method of claim 1 further comprising the step of forming the part at a plurality of draw stages prior to forming said primary step, the draw shoulder on the draw punch at each successive stage being enlarged to increase definition of the step on the side walls during each stage of drawing.

6. A method for forming a material into a part having side walls and a bottom portion comprising the steps of:

contacting the bottom portion of the part with the nose portion of a first draw punch, said first draw punch having an enlarged diameter portion to define a draw shoulder between the nose portion and enlarged diameter portion;

drawing the material through a first draw die with said first draw punch to form the material;

forming a primary annular step on the side walls of the part and concentric to the axis of symmetry to the part;

contacting the bottom portion of the part with the nose portion of a second draw punch, said second draw punch having an enlarged diameter midportion adjacent said nose portion to define a first draw shoulder between the nose portion and the enlarged diameter midportion, said second draw punch having a neck portion with the diameter larger than said midportion to define a second draw shoulder therebetween;

drawing the material through a second draw die with the second said draw punch to form the material;

forming a secondary annular step on the side walls of the part perpendicular and concentric to the axis of symmetry of the part with said first draw shoulder of said second draw punch, said second draw shoulder mating with said primary step formed by said first draw punch;

contacting the bottom portion of the part with a finishing punch, said finishing punch having a nose portion and an enlarged diameter portion to define a finishing shoulder between the nose portion and the enlarged diameter portion; and forming the part through a finishing die with said finishing punch, the finishing shoulder on said finishing punch being positioned to transmit preselected forces to the part through the step on the part while the part is formed through said finishing die.

7. The method of claim 6 further comprising the step of forming the part at a plurality of draw stages preceding the forming of said primary annular step, the width of the draw shoulder on each successive draw stage being enlarged to increase the size of the primary step during the stage of drawing.

* * * * *